United States Patent [19]

Bourlier et al.

[11] Patent Number: 4,523,527

[45] **Date of Patent: * Jun. 18, 1985**

[54] SECURITY APPARATUS FOR THE PASSAGE OF OBJECTS

[76] Inventors: Claude P. Bourlier, 3 rue J.F. Belbeoch, 94410 Saint Maurice; Louis E. Sallot, 9 rue du Général Leclerc, 92270 Bois Colombes, both of France

[ * ] Notice: The portion of the term of this patent subsequent to Nov. 10, 1998 has been disclaimed.

[21] Appl. No.: 229,230

[22] Filed: Jan. 28, 1981

[30] Foreign Application Priority Data

Feb. 15, 1980 [FR] France ..... 80 03400

[51] Int. Cl.[3] ..... E06B 7/32

[52] U.S. Cl. ..... 109/19; 109/48; 232/43

[58] Field of Search ..... 109/10, 19, 16, 3, 5, 109/8, 11, 13, 45, 48, 73; 24/230 R; 104/35; 232/43.3, 43.4; 108/94; 16/82; 46/140; 312/211, 212

[56] References Cited

U.S. PATENT DOCUMENTS

| | | | |
|---|---|---|---|
| 506,530 | 10/1893 | McGrady | 24/230 R |
| 1,091,556 | 3/1914 | Bartels | 109/48 |
| 1,346,823 | 7/1920 | Hecht | 109/19 |
| 1,761,747 | 6/1930 | Rosin et al. | 104/35 |
| 1,804,776 | 5/1931 | James | 109/19 |
| 1,885,560 | 11/1932 | Hassey | 109/19 |
| 1,924,330 | 8/1933 | Scheeler | 109/19 |
| 3,702,101 | 11/1972 | Moore | 109/19 |
| 4,157,071 | 6/1979 | King | 109/19 |
| 4,299,175 | 11/1981 | Bourliet et al. | 109/19 |

FOREIGN PATENT DOCUMENTS

| | | | |
|---|---|---|---|
| 722086 | 12/1931 | France | 109/48 |

*Primary Examiner*—Gene Mancene
*Assistant Examiner*—James Hakomaki
*Attorney, Agent, or Firm*—James C. Wray

[57] ABSTRACT

This apparatus is of the kind comprising a fixed frame 1 and a drum 5 having a vertical axis for rotation relative to and within the frame about a vertical axis, this drum comprising an internal cavity intended to receive the objects to be passed and accessible through an opening formed in the vertical wall of the drum, the apparatus also comprising means for stopping and locking the drum relative to the chassis in two diametrically opposite positions.

According to the invention, these means for stopping and locking the drum relative to the frame comprise an abutment fixed to the end 12 of the drum and another abutment 17 fixed on the end 8 of the frame, and also an inclined leaf spring which can withdraw vertically out of the way when the stop of the drum passes, the gap e left between the end of the frame and the end of the drum corresponding practically to the vertical dimension of these abutments alone.

The invention has particularly advantageous application in government offices, banks, etc.

15 Claims, 8 Drawing Figures

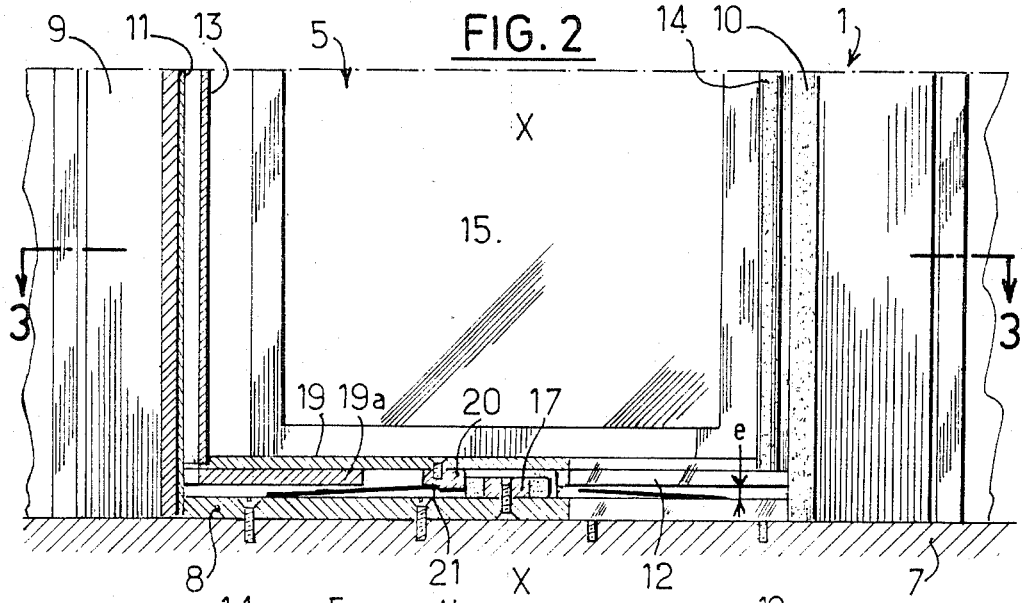
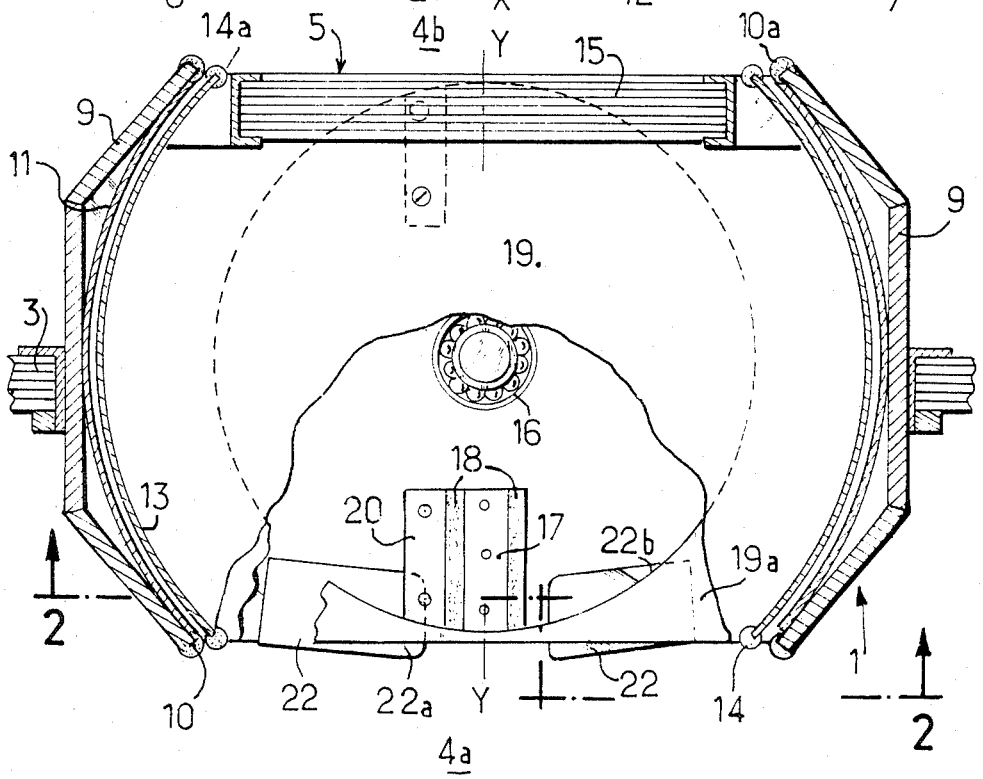
FIG. 3

SECURITY APPARATUS FOR THE PASSAGE OF OBJECTS

The present invention concerns security apparatus for the passage of objects, intended to be fitted in an opening in a wall separating two rooms, or a room and the outside, which are isolated relative to each other, of the type comprising a fixed frame and a drum having a vertical axis mounted for rotation relative to and within the frame about a vertical axis, the drum having an internal cavity intended to receive objects to be passed and accessible through an opening in the vertical wall of the drum, the apparatus also comprising means for stopping and locking the drum relative to the frame in two diametrically opposite positions.

In apparatus of this kind, the drum can be brought successively to each of the two positions, in which its opening is directed respectively to each of the two rooms so as to receive an object in its cavity from the first room when it is in the first position, this object being removed from it into the second room when it is in the second position.

These apparatus can usefully be used in government agency offices or bank premises, where packages are to be handed by a user or a customer to an official who, for reasons of security, must be perfectly isolated from the public, but they are of course usable in many other circumstances, for example in sales premises frequented at night, such as pharmacies, where complete security is also required.

Apparatus of this kind, for example from U.S. Pat. No. 4,299,175 of the Applicants, which are intended to be fitted in a partition situated above a counter and in which the drum is in the shape of a cylinder sectioned along two parallel vertical planes, of which one forms the access opening of the internal cavity, while the other forms a second opening which is shut by an observation window in bullet-proof transparent material, the frame itself matching with the shape of a cylinder sectioned along two planes. In this apparatus the frame presents at its base two bottoms separated by a large space in which are situated the locking means, comprising a lever of large dimensions solid with the axis of the drum (which is mounted for rotation on the second bottom of the frame) and which cooperates with ramps and stops disposed under this double bottom of the frame, the lever also serving for the manual control of the rotation and locking of the drum.

Now, the height required between the two bottoms of the frame is relatively big and can often reach 15 cm, so that the bottom of the drum is raised by a corresponding amount relative to the counter, which requires a considerable effort from the user to hoist up to the level of the drum objects which are often very heavy and can reach 10 to 15 Kg in the case of postal packets or parcels.

For these reasons, the present invention has as object to provide apparatus of the kind referred to which does not need such an effort from the user and, to this end, concerns such apparatus characterised in that the means for locking the drum relative to the frame comprise, on one hand, at least one stop or abutment fixed to the end of the drum and, disposed in the circular path of that stop, or another stop fixed on the end of the frame and, on the other hand, also disposed in the circular path of the drum and fixed on the end of the frame, at a distance from the stop of the frame equal to the circumferential dimension of the stop of the drum, a leaf spring inclined slightly to the horizontal which can withdraw vertically out of the way when the stop of the drum passes, the distance between the end of the frame and the end of the drum corresponding practically to the vertical dimension of the stops alone, the device also comprising means for damping the movement of the stops abuting against each other.

Due to this arrangement, the user can turn the drum until it is halted by abutment between the two stops, the leaf spring which withdrew out of the way of the stop of the drum, repositioning itself behind the stop of the drum to lock the assembly in the stop position. It is then sufficient for the user to press on the leaf spring to free the drum and turn it in the opposite direction. The damping means avoid a violent shock being produced when the drum contacts the stop of the frame, particularly in the case of devices of large dimensions. This result is very important, as manual stopping of the drum can thus be avoided, manual stopping being potentially very dangerous, particularly in the case where, as indicated below, the drum is very heavy and mounted on ball bearings, for in this case there is a risk of a hand being trapped in the vertical gap separating the drum and the chassis, with consequent risk of causing wounds. In addition, it is very useful to have a device which stops the drum in a very precise position in the case where the frame mates with the shape of the drum and especially with its access opening, as it is then possible to introduce into the drum an object which is almost as large as its opening only if this opening is disposed very exactly in front of the corresponding opening of the frame.

In a particularly advantageous embodiment of the invention, there are provided two stops fixed underneath the bottom of the drum in approximately diametrically opposite fashion, and two leaf springs fixed above the bottom of the frame on each side of the stop of the frame. Thus the two leaf springs enabling the drum to be unlocked are disposed on the same side of the device and only the designated user such as the official or salesman can operate the unlocking, the user on the other side, such as a customer, having no facility for this, thus ensuring excellent operational security.

It is essential to note that, in apparatus in accordance with the invention, the drum is mounted for rotating on the frame by simple rolling bearing means, such as ball bearings, which require no greasing, and not by a bush requiring greasing, so that the rotary movement is perfectly free and smooth, the drum being movable by simply pushing by hand without any resistance, the damping means then acting to limit, by an amount which can be regulated, the freedom to rotate and the inertia which can result from it, which is all the greater the bigger and therefore heavier the apparatus is. It was indeed considered preferable to give the drum complete freedom to rotate and to control, according to the particular application, the amount of damping for the movement.

Thus, already the sprung withdrawal of the locking spring gives a first effect of damping during the passage of the stop of the drum. Moreover, in an embodiment, the stop of the frame comprises damping means which are disposed facing the path of each stop of the drum and the stop of the frame can either consist of a stop fixed rigidly to the bottom of the frame and on which is fixed, facing the path of each stop of the drum, a compressible element, or consist of the end of a flexible element whose other end is fixed rigidly to the bottom of the frame, for example a radial horizontal rod fixed to the bottom of the frame beside the axis of rotation of the drum. These various means can be used separately or in combination as a function of the amount of shock absorbing necessary.

These means can be used in particular in the case of apparatus of normal or moderate dimensions, but it should be noted that in the very special case of security apparatus in which the materials used are either steel of thick gauge 0.5 to 1 cm, or sheets of bullet proof glass whose thickness can reach 25 to 35 mm, the drums of these apparatus already have for diameters exceeding 50 cm and heights of about 1 m, weights of 30 to 50 kg, to which is added the mass of the objects which are placed in it. The inertia of such a drum which has started to rotate is therefore considerable and the damping means must be designed in consequence.

It is all the more important for this condition to be respected for very large apparatus where the weight of the drum can reach or even exceed 100 kg and this is the reason why, in another embodiment of the invention, there are otherwise provided independent damping means associated with the other end of the drum and the other end of the frame from the ends which bear the stop and locking means, these damping means comprising another stop fixed on the end of the drum and, disposed in the circular path of this stop, for each stop position of the drum, a fluid damper such as a pneumatic piston.

Other features and advantages of the invention will appear from the following description, given by way of non-limitative example, with reference to the accompanying drawings, in which:

FIG. 2 shows a partial elevational view partly in section along the line 2—2 of FIG. 3 of the apparatus.

FIG. 3 shows a plan view of the same apparatus, taken in section along the line 3—3 of FIG. 2.

Figure 1:
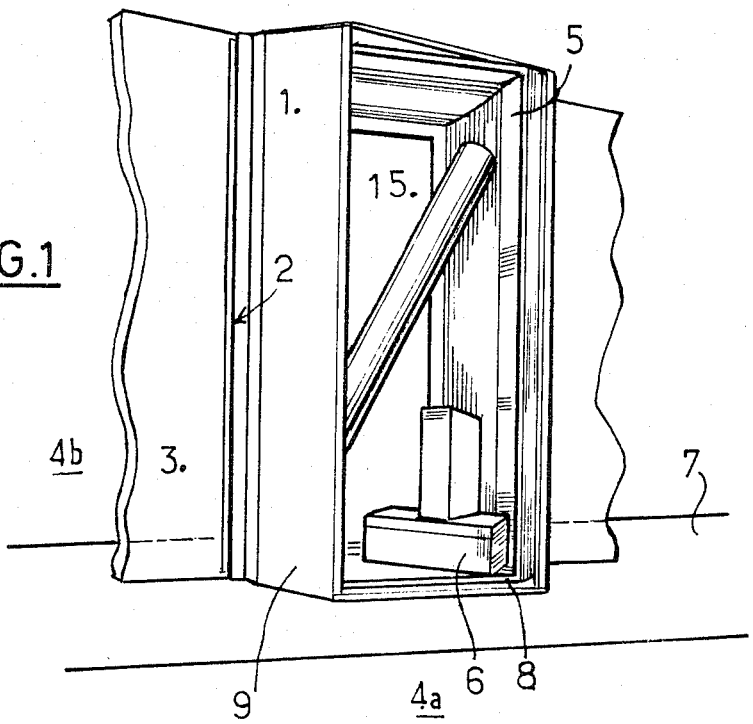
FIG. 1 shows a perspective view of apparatus according to a first embodiment of the invention.

The apparatus of FIG. 1 comprises a fixed frame 1 which is mounted in an opening 2 in a wall 3 separating two rooms 4a and 4b isolated from each other, and a drum 5 disposed within this frame 1 and comprising an internal cavity intended to receive objects 6 to be passed, the assembly of the apparatus frame and drum, and of the wall 3 being borne directly on the horizontal surface of a body height counter 7.

As shown more precisely in FIGS. 2 and 3 the frame 1 comprises a bottom end 8 which is positioned and fixed on the counter 7, this bottom having an octagonal shape of which two sides are parallel to the plane of the wall 3 and are disposed symmetrically on each side of the wall, being longer than the other sides, the frame also comprising a top end 8a having the same shape and which is connected to the bottom by vertical walls 9 disposed along the six remaining sides of the octogonal ends, leaving vertical rectangular access 10 and 10a formed between the longer sides and facing respectively the two rooms 4a and 4b. The walls 9 are lined inside by two internal walls 11 of cylindrical sector shape which are also separated by the openings 10 and 10a, these two cylindrical sectors being centred on a vertical axis X—X which forms a general axis of symmetry for the complete device. The assembly of the walls 9 and 11 is designed in such a way as to be bullet proof and consists, for example, of thick aluminium for the outer wall 9 and of stainless steel for the inner wall 11. The frame therefore forms a closed protective casing.

The drum 5 itself comprises a bottom end 12 disposed directly above the bottom 8 of the frame, a top end 12a disposed directly beneath the top 8a of the same frame and two vertical walls 13 of cylindrical sector shape which have practically the same shape and size as the walls 11 of the frame, but on a slightly smaller radius so as to leave a small play between these walls 13 and 11. The ends 12 and 12a therefore have circular shapes sectional along two parallel directions, these shapes defining with the edges of the vertical walls 13 two rectangular vertical openings 14 and 14a which are diametrically opposed about the axis X—X and of which one forms an access opening 14 to the internal cavity of the drum, whereas the other one 14a is shut by a bullet-proof window 15, of very thick gauge, which enables perfect observation, in complete security, from one side of the device to the other.

The drum 5 is mounted for rotation within the frame 1 about the vertical axis X—X by means of two ball-bearings 16 and 16a interposed respectively between the bottoms of these two elements and between their tops.

In addition, the apparatus comprises means for stopping and locking the drum relative to the frame in two diametrically opposite positions, in which the openings 14 and 14a of the drum coincide very exactly with the openings 10 and 10a of the frame.

These stopping and locking means comprise firstly a first stop 17 which is fixed on the upper face of the bottom 8 of the frame and which consists of a thin elongate plate extending radially in the direction Y—Y perpendicular to the access openings 10 and 10a of the frame, its elongate direction extending in the direction of the axis X—X, whereas its outer end is disposed adjacent to the edge of the opening 10 of the frame facing the room 4a where the designated user is to be. The two radial vertical faces of this stop 17 bear damping or shock absorbing rubber pads 18.

The bottom end 12 of the drum comprises a rigid plate or bottom 19 underneath which is fixed another plate 19a having the same outer shape, but which is apertured in its central part so as to define a bowl of circular area whose diameter is slightly less than the distance separating the two straight sides of this bottom which corresponds to the openings 14 and 14a of the drum. Within this bowl are disposed two stops 20 and 20a which are formed by thin elongate plates which are fixed in approximately diametrically opposed fashion underneath the bottom 19, being disposed moreover adjacent to the shoulder formed by the second plate 19a. These two stops are in fact off-set relative to the diametrically opposite positions so that in the position shown in FIG. 3, for which the openings 10 of the frame and 14 of the drum coincide, the stop 20 is disposed parallel to the stop 17 and is brought into abutment with the pads 18 borne by the stop 17. The other stop 20a is also slightly off-set so as to be able to come directly into abutment with the other pad 18 disposed on the opposite face of the stop 17 when the drum turns exactly 180° about the axis X—X.

Each of the stops 20 and 20*a* has on its lower face a shoulder 21 extending parallel to its length, that is to say approximately radially. The thicker part defined by this shoulder is disposed on the same side as the stop 17 of the frame, while the thinner part extends the opposite way and is of thickness just exactly equal to that of the plate 19*a* on the bottom of the drum.

Lastly, on each side of the stop 17 of the frame, and also fixed to the upper face of the bottom 8, are provided two leaf springs 22 of approximately rectangular shape which extend approximately in the direction of the straight edge of this bottom 8, being fixed to this bottom at their end more remote from the stop 17 while the closer end engages just exactly against the shoulder 21 of one or other of the stops 20 and 20*a* (according to which one contacts the stop 17), each leaf spring being thus slightly inclined to the horizontal so as to cross the very small gap e left between the plate 19*a* of the drum and the bottom of the frame. The stops 20 and 20*a* of course only project beneath the plate 19*a* by the small extra thickness defined by the shoulder 21, this extra thickness being accommodated within the gap e referred to above. As for the stop 17, its height is such that it is easily accommodated in the depth of the bowl defined within the plate 19*a*, increased by the same gap e. The leaf springs 22 are disposed on their larger surface above the bottom 8 of the frame, but they are slightly inclined relative to the edge of the frame, so that the outer corner 22*a* of their free edge projects slightly out in front of the opening 10 at the level of the gap e.

The apparatus described above operates as follows:

In the position shown in FIG. 3, the drum 5 presents its access opening 14 on the same side as the room 4*a* where the designated user is, for whom the security conditions are intended to be respected. As indicated above, the stop 20 of the drum abuts against one of the pads 18 of the stop 17 of the frame and one of the leaf springs 22 is engaged behind the shoulder 21 of the same stop 20, which simultaneously ensures that the drum is halted in the relevant position and that it is perfectly locked in this position.

When a third party in the room 4*b* has to transfer an object such as a packet to the room 4*a*, the designated user presses on the projecting part 22*a* of the leaf spring 22 currently engaged so as to disengage the stop 20, which enables the drum to be pushed by hand to make it turn through 180° about the vertical axis. This rotation then brings the opening 14 of the drum in front of the opposite opening 10*a* of the frame, whereas the security window 15 is brought to the side of the designated user. At the end of this rotation, the other stop 20*a* is brought into abutment with the other pad 18, the presence of this pad 18 ensuring damping at the end of the movement so as to avoid a violent shock being produced because of the high inertia of the rotating mass. Because of the compression of the pad 18, the drum goes beyond the ultimate stop position, in fact, which enables the leaf spring 22 to engage behind the shoulder 21 on the stop 20*a*. It should also be noted that, when this stop 20*a* approaches the abutment zone, the corner which it presents in the vicinity of the leaf spring 22 is placed close above the leaf spring, then slides along it, pushing it down out of the way until the stop comes into contact with the pad 18, in which position, as indicated above, the free edge of the leaf spring can lift up and press behind the shoulder 21. It should therefore particularly be noted that the length and inclination of each leaf spring 22 are provided in such a way that at the precise place where the leaf spring 22*b* is underneath the rim of the bowl defined by the plate 19*a*, the leaf spring is disposed normally at a distance from the main plate 19 of the bottom which is slightly greater than the greatest thickness of the stop 20.

It will thus be seen that not only is the bottom 12 of the drum disposed closely above the bottom 8 of the frame, which enables objects to be introduced into this drum without having to lift them to a high level, but also the only gap left between these bottoms is sufficiently slight to prevent the passage of a bullet, ensuring thus perfect security of the complete device.

In the new position where the opening 14 of the drum faces the room 4*b*, the outside user can introduce into the enclosure of the drum the objects or packets that he has to transfer. The designated user observes this operation perfectly through the bullet-proof window 15 and can then actuate the locking leaf spring 22, so as to free the drum again and rotate it in the opposite direction, again through 180°, so as to bring it back to its initial position where he can then take the objects out of the drum.

It is clear that even if a packet placed in the drum has a horizontal dimension corresponding to the width of the opening 14, it is perfectly possible to introduce and remove this packet without difficulty, because of the precise positioning of this opening 14 alternatively in front of the openings 10*a* and 10 of the frame.

The operation described above assumes that only a ball-bearing 16*a* is provided at the top of the drum.

Figure 4:
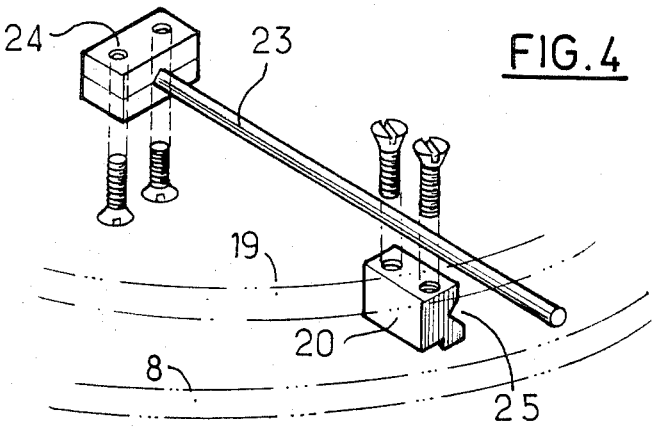
FIG. 4 shows a partial perspective view of a variant according to the invention.

In the variant of FIG. 4, the stop 17 of the frame and its pads 18 are replaced by two flexible metallic rods (of which only one is shown in the drawing) which are disposed at the place of the two pads 18 in FIG. 3. Each rod 23 extends in the same main direction as the pad 18 and it is fixed by its inner end between two plates 24 fixed to the bottom 8 of the chassis. The stops 20 and 20*a* are slightly modified in such a way as to present a horizontal V-shaped section groove which is of approximately the same dimension as the rod 23.

This apparatus operates in practically the same way, the stop 20 or 20*a* pushing out of the way the leaf spring 22 to abut subsequently against the rod 23 by its groove 25 and distort the rod by bending it in the horizontal direction while the drum goes beyond its ultimate stop position before coming back to this stop position under the elastic effect of the rod 23. The rod 23 therefore has the perfect damping function, with a greater effect than the pads 18, so that this variant can be used on devices which are bigger and heavier.

Figure 7:
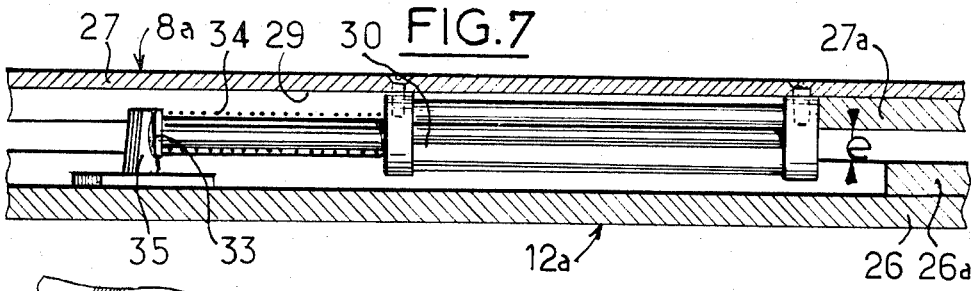
FIG. 7 shows a sectional view taken along the line 7—7 of FIG. 6.
Figure 6:
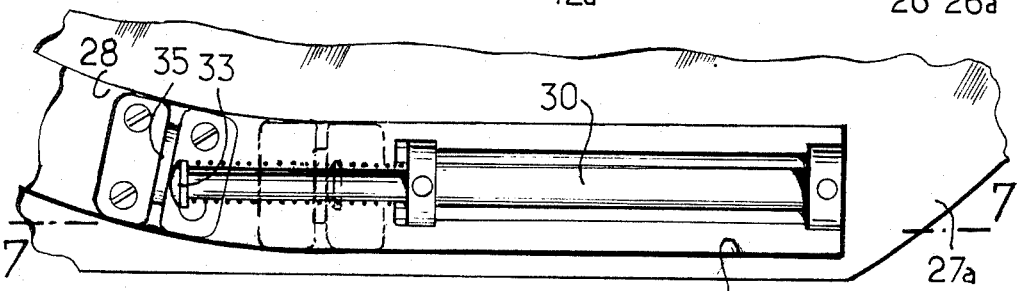
FIG. 6 shows a partial underneath view of the top of the drum of this apparatus.
Figure 5:
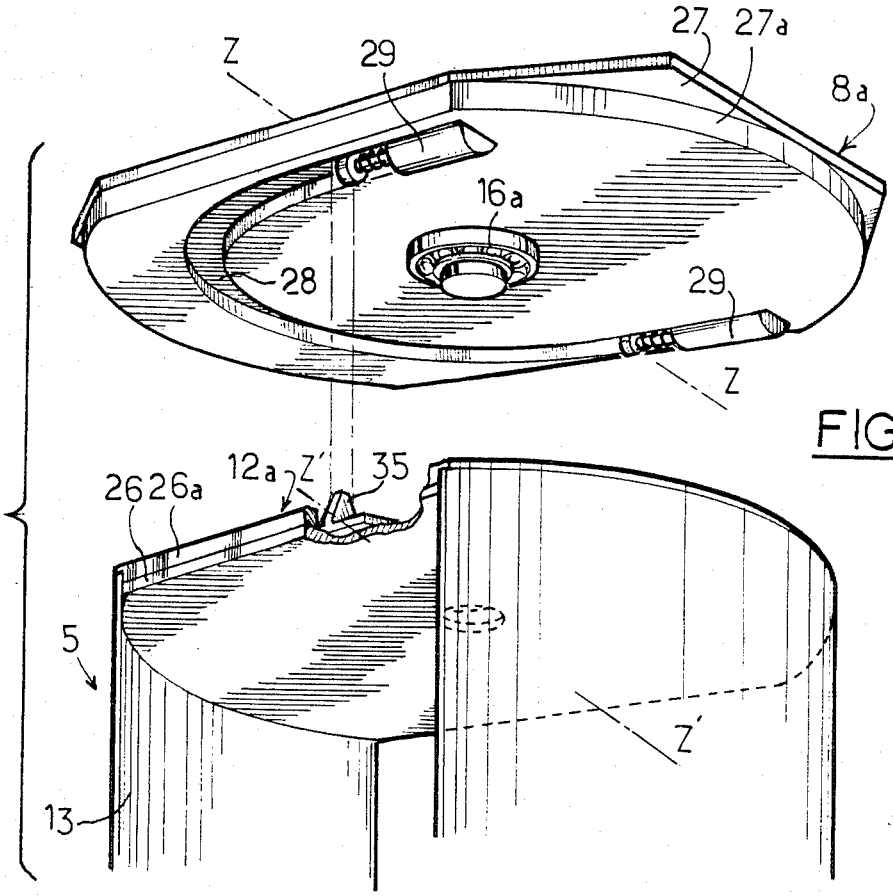
FIG. 5 shows a partial exploded view of apparatus according to a second embodiment of the invention.

FIGS. 5 to 7 show additional damping means disposed on top of the drum. The top end 12*a* is made in the same way as the bottom end 12, in that it is formed on the one hand by a full top end 26 corresponding to the end 19 and on the other hand by an apertured top end 26*a* corresponding to the plate 19*a*. As for the end 8*a* of the frame, it consists of a full plate 27 having the same shape as the bottom end 8 and, disposed above this plate 27, an additional plate 27*a* whose profile is circular and sectioned in the same way as the bottom 12 and 12*a* of the drum, this plate 27*a* also having, through its thickness, a window 28 of semi-circular shape centred on the axis X—X and with housings 29 extending both its ends and of rectangular section.

In each of the housings 29 is disposed a fluid damper (30) of the air damper type. The damper comprises a cylinder which is fixed on the plate 27 and within which slides a piston 31 disposed at the end of a rod 32 which projects out of the cylinder towards the groove 28, the axis of the cylinder being also directed tangentially to the circular shape of the groove. The rod 32 is terminated by a head 33 and a coil spring 34 is disposed between this head and the cylinder 30.

The diameter Z—Z which defines the semi-circular shape of the groove 28 is directed parallel to the direction Y—Y in which the bottom stop 17 is disposed, that is to say perpendicular to the openings in the chassis. The length of the rods 32 of the dampers 29 is such that when they are fully extended out of the cylinders 30 by the springs 34, their heads 33 extend a certain distance beyond the position of the diameter Z—Z which are to correspond to the stop positions of the drum.

The height of this apparatus is extremely small, given that between the plates 26*a* of the end of the drum and 27*a* of the end of the frame there is only left a gap e equivalent to the gap left at the bottom of the device. The cylinders 30 of the dampers can also easily be accommodated in height between the non-apertured plates 27 of the frame and 26 of the drum, the cylinders 20 being partly in the bowl left within the plate 26*a* of the drum.

Lastly, a stop 35 is provided fixed to the main plate 26 of the end of the drum in such way that its end projects into the groove 28 of the end of the frame. This stop is fixed on the plate 26 in the horizontal axis of symmetry Z'—Z' of the plate 26, perpendicular to the edge of this plate corresponding to the access opening 14.

The damper operates in the following way:

When the user rotates the drum 5, the stop 35 contacts the head 33 of one of the two dampers and pushes the rod of the damper in progressively, the air contained within the cylinder being compressed in spite of a certain leakage around the head 31 which is designed in the same way as the piston head of a bicycle pump.

The same happens when the drum is brought to the diametrically opposite position, the stop 35 coming to cooperate with the other damper 30.

Figure 8:
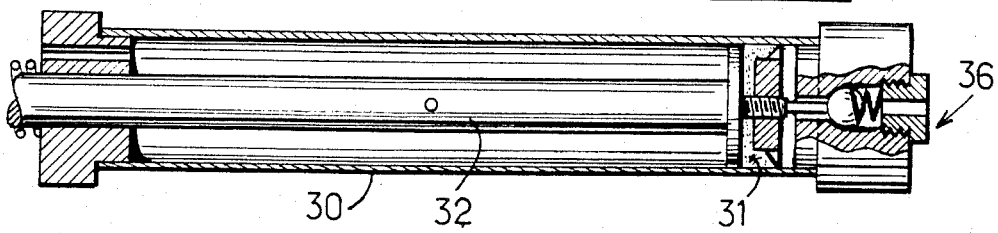
FIG. 8 shows a detail view of the air piston of FIGS. 5 to 7.

As shown in FIG. 8, a ball valve is preferably provided at the end of the cylinder 30 opposite the rod 32, the ball valve allows complete exhausting of the air compressed by the piston head 31.

We claim:

1. Apparatus for rotary transfer of objects, of the kind comprising a fixed frame and a rotary element mounted for rotation relative to said frame about a vertical axis, said rotary element comprising a cavity for receiving the objects to be transferred, means for stopping and locking the rotary element relative to the frame in two diametrically opposite stop positions, said rotary element defining an opening for access to said cavity, and said frame defining corresponding diametrically opposite openings which are respectively juxtaposed with said opening of the rotary element in said two stop positions, whereby said cavity is accessible for the transfer of an object alternatively from opposite sides of said frame, said stop and locking means comprising at least one abutment on the end of the rotary element and, projecting into the circular path of this abutment, at least one abutment on the corresponding end of the frame, characterised in that the means for stopping and locking 20, 20*a*, 17, 23, 22 the rotary element 5 relative to the frame (1) comprise leaf spring means 22, also projecting into the circular path of said at least one abutment 20, 20*a* of the rotary element (5) and mounted on the end 8 of the frame (1), said leaf spring means presenting at least one locking edge for engaging said at least one abutment of the rotary element whereby to lock said rotary element in said stop positions, and at least one ramp surface inclined to the horizontal whereby said at least one abutment can ride over said leaf spring means as said rotary element rotates towards said stop positions, and damper means for damping rotation of said rotary element towards said stop positions.

2. Apparatus according to claim 1, characterised in that the rotary element is an elongate drum presenting a vertical wall defining said access opening 12*a*, said abutments 20, 20*a*; 17, 23 and the leaf spring means 22 being disposed on the bottom 8, 12; 8*a*, 12*a* of said frame and said rotary element the gap e left between the end 8 of the frame and the end 12 of the drum corresponding to the vertical dimension of said abutments only.

3. Apparatus according to claim 2 characterised in that said stop and locking means comprises two abutments 20, 20*a* fixed to the underneath of the bottom 12 of the rotary element in approximately diametrically opposite positions, said leaf spring means comprising two leaf springs 22 fixed on the bottom 8 of the frame on each side of the abutment (17, 23) of the frame (1).

4. Apparatus according to claim 1 characterised in that said leaf spring means 22 projects slightly beyond the periphery of the rotary element 5, through the gap (e) left between the end 12 of the rotary element and the end (8) of the frame, whereby said locking edge may be depressed manually to free said abutment.

5. Apparatus according to claim 1 characterised in that said damper means comprises resilient means (18) projecting into the path of said at least one abutment (20, 20*a*) of the rotary element.

6. Apparatus according to claim 5, characterised in that said abutment 17 of the frame 1 comprises a rigid stop on the end (8) of the frame and said resilient means comprises compressible elements 18 mounted on said stop.

7. Apparatus according to claim 1, characterised in that said damper means comprises a flexible element 23 mounted at one end on the end 8 of the frame 1, said abutment of the frame comprising a stop mounted on the other end of said resilient element.

8. Apparatus according to claim 7, characterised in that the flexible element 23 is formed by a horizontal radial rod fixed on the end 8 of the frame 1 adjacent to the axis of rotation X—X of the rotary element 5.

9. Apparatus according to claim 2, characterised in that further damper means 30, 35 are provided associated with the other end 18*a* of said rotary element (5) and the other end 8*a* of the frame 1 from those which bear the stop and locking means 20, 20*a*, 17, 23, 22.

10. Apparatus according to claim 9, characterised in that the further damper means 30, 35 comprise a further abutment 35 on the end 12*a* of the drum 5 and, disposed in the circular path of this abutment, and for each stop position of the drum, a fluid damper 30.

11. Apparatus according to claim 10, characterised in that each fluid damper 30 is formed by an air piston.

12. Apparatus according to claim 1 characterised in that said frame 1 presents a horizontal shape matching that of the rotary element 5, presenting an access opening 10 having practically the same width and each abutment 20, 20*a* of the rotary element 5 is disposed on the rotary element substantially in the plane of symmetry (Y—Y) of this shape and of this opening.

13. Apparatus according to claim 1 characterised in that the end 12 of the rotary element is formed by the superposition of a plate 19 on which is fixed each abutment 20, 20*a*, 23 of the drum, and of a plate 19*a* presenting a circular recess in which can extend the abutment 17 of the frame.

14. Apparatus according to claim 10 characterised in that the end 8*a* of the frame 1 at which said further damper means is mounted is formed by the superposition of a plate 27 on which is fixed each fluid damper 30 and of a plate (27*a*) presenting an annular groove 28 in which can travel the abutment 35 of the rotary element.

15. Apparatus according to claim 14 characterised in that the end 12*a* of the drum 5 is formed by the superposition of a plate 26 on which is fixed said further abutment 35 of the drum, and of a plate 26*a* presenting a circular recess in which can travel each fluid damper.

* * * * *